US010607550B2

(12) United States Patent
Zhou et al.

(10) Patent No.: US 10,607,550 B2
(45) Date of Patent: Mar. 31, 2020

(54) DIGITAL CONTROL DRIVING METHOD AND DRIVING DISPLAY DEVICE

(71) Applicant: SHENZHEN CHINA STAR OPTOELECTRONICS SEMICONDUCTOR DISPLAY TECHNOLOGY CO., LTD., Shenzhen, Guangdong (CN)

(72) Inventors: Xuebing Zhou, Guangdong (CN); Yi-Chien Wen, Guangdong (CN); Ming-Jong Jou, Guangdong (CN)

(73) Assignee: SHENZHEN CHINA STAR OPTOELECTRONICS SEMICONDUCTOR DISPLAY TECHNOLOGY CO., LTD., Shenzhen, Guangdong (CN)

( * ) Notice: Subject to any disclaimer, the term of this patent is extended or adjusted under 35 U.S.C. 154(b) by 56 days.

(21) Appl. No.: 16/040,626

(22) Filed: Jul. 20, 2018

(65) Prior Publication Data

US 2019/0279577 A1 Sep. 12, 2019

Related U.S. Application Data

(63) Continuation of application No. PCT/CN2018/080028, filed on Mar. 22, 2018.

(30) Foreign Application Priority Data

Mar. 6, 2018 (CN) ..... 2018 1 0184875

(51) Int. Cl.
*G09G 3/3275* (2016.01)
*G09G 3/00* (2006.01)
(Continued)

(52) U.S. Cl.
CPC ..... *G09G 3/3275* (2013.01); *G09G 3/003* (2013.01); *G09G 3/2022* (2013.01);
(Continued)

(58) Field of Classification Search
CPC .... G09G 3/3275; G09G 3/003; G09G 3/2022; G09G 3/3258; G09G 3/3688;
(Continued)

(56) References Cited

U.S. PATENT DOCUMENTS

2011/0001806 A1* 1/2011 Nakahata ..... G09G 3/003 348/56
2013/0241977 A1* 9/2013 Okamoto ..... G02B 27/26 345/691
2016/0189620 A1* 6/2016 Park ..... G09G 3/3258 345/690

* cited by examiner

*Primary Examiner* — Sahlu Okebato
(74) *Attorney, Agent, or Firm* — Leong C. Lei

(57) ABSTRACT

A digital control driving method and a driving display device are disclosed. In the method, dividing an image frame into K sub-frames by a hit using a digital control method is adopted. Wherein in one frame period of the image frame, an occupied time of each K sub-frame is the same, and driving times of the K sub-frames are different. The K sub-frames are driven to display on the display panel in a special transmission mode within one frame time of the image frame. The transmission voltage value has only two values, corresponding to the light emission and non-emission of the pixel points on the display panel. The source driver IC only output two grayscale voltages so as to effectively avoid a drift of the Vth of the driving TFT such that an entire brightness of the AMOLED panel is even to improve the display quality.

18 Claims, 6 Drawing Sheets

(51) Int. Cl.

| | |
|---|---|
| ***G09G 3/20*** | (2006.01) |
| ***G09G 3/3258*** | (2016.01) |
| *G09G 3/36* | (2006.01) |

(52) U.S. Cl.

CPC ..... *G09G 3/3258* (2013.01); *G09G 3/3607* (2013.01); *G09G 3/3688* (2013.01); *G09G 2310/0205* (2013.01); *G09G 2310/027* (2013.01); *G09G 2310/0213* (2013.01); *G09G 2310/0221* (2013.01); *G09G 2310/0251* (2013.01); *G09G 2310/08* (2013.01); *G09G 2320/0233* (2013.01); *G09G 2320/045* (2013.01)

(58) Field of Classification Search

CPC ..... G09G 3/3607; G09G 2310/0205; G09G 2310/0213; G09G 2310/0221; G09G 2310/0251; G09G 2310/027; G09G 2310/08; G09G 2320/0233; G09G 2320/045

See application file for complete search history.

DIGITAL CONTROL DRIVING METHOD AND DRIVING DISPLAY DEVICE

CROSS REFERENCE

This application is a continuing application of PCT Patent Application No. PCT/CN2018/080028, entitled "DIGITAL CONTROL DRIVING METHOD AND DRIVING DISPLAY DEVICE", filed on Mar. 22, 2018, which claims priority to China Patent Application No. 201810184875.X filed on Mar. 6, 2018, both of which are hereby incorporated in its entireties by reference.

FIELD OF THE INVENTION

The present invention relates to a driving display technology filed, and more particularly to a digital control driving method and a driving display device.

BACKGROUND OF THE INVENTION

An active matrix organic light-emitting diode (AMOLED) panel has many applications in the 3D display field, virtual reality (VR), etc. because of its fast response, ultra-thin, ultra-light, and colorful colors. However, in the AMOLED pixel circuit, the OLED current (Ioled) is not linearly related to Vgs and Vth of the driving TFT, and the Vth of the driving TFT may drift over time, resulting in a change in the Ioled, and an overall uneven brightness of the AMOLED panel.

There are many kinds of driving methods to reduce or solve the influence of the Vth drift of the driving TFT. In the prior art, the analog driving methods that uses internal or external compensating circuits for pixels are adopted, but this method is more complicated, and how to simply and efficiently solve the Vth drift of driving TFT over time is a hot issue that is researched by those skilled in the art.

SUMMARY OF THE INVENTION

Accordingly, in order to solve the problem of the Vth of the driving TFT may drift over time, resulting in a change in the Ioled, and an overall uneven brightness of the AMOLED panel, a digital control driving method and a driving display device are disclosed such that the source driver IC only output two grayscale voltages so as to effectively avoid a drift of the Vth of the driving TFT such that an entire brightness of the AMOLED panel is even to improve the display quality.

A PWM control driving method is disclosed, and the method includes steps of: receiving an image frame; dividing the image frame into K sub-frames, wherein a grayscale range of pixel points in the image frame of a display system corresponds to K bits, an i-th sub-frame includes a value of an i-th bit of each pixel point, i is greater than or equal to 1, and less than or equal to K; and according to values in a j-th sub-frame, using a driving time corresponding to the j-th sub-frame to drive thin-film transistors (TFT) in a display panel to turn on or turn off; wherein, j is sequentially assigned from 1 to K, a first value of a bit is used for indicating to drive the TFTs to turn on, and a second value of the bit is used for indicating to drive the TFTs to turn off.

Wherein the image frame includes a 3D image frame, and the 3D image frame includes a 3D left-eye image frame and a 3D right-eye image frame.

Wherein the step of dividing the image frame into K sub-frames includes: respectively dividing the 3D left-eye image frame and the 3D right-eye image frame into K sub-frame; wherein the step of according to values in a j-th sub-frame, using a driving time corresponding to the j-th sub-frame to drive thin-film transistors (TFT) in a display panel to turn on or turn off includes: according to values in the j-th sub-frame of the 3D left-eye image frame, using a driving time corresponding to j-th sub-frame to drive TFTs in the display panel to turn on or turn off, wherein j is sequentially assigned from 1 to K; and after the 3D left-eye image frame finishes driving and displaying, according to values in the j-th sub-frame of 3D right-eye image frame, using a driving time corresponding to the j-th sub-frame to drive TFTs in the display panel to turn on or turn off, wherein j is sequentially assigned from 1 to K.

Or, according to values in the j-th sub-frame of the 3D left-eye image frame, using a driving time corresponding to j-th sub-frame to drive TFTs in the display panel to turn on or turn off, wherein j is sequentially assigned from 1 to K; and after the j-th sub-frame of the 3D left-eye image frame drives the TFTs in the display panel to turn on or turn off, according to values in the j-th sub-frame of 3D right-eye image frame, using a driving time corresponding to the j-th sub-frame to drive TFTs in the display panel to turn on or turn off, wherein j is sequentially assigned from 1 to K.

Wherein in one frame period of the image frame, an occupied time of each K sub-frame is the same, and driving times of the K sub-frames are different.

Wherein if a grayscale range of the display system is 0-255, K is equal to 8, the one frame period of the image frame is T, a driving time corresponding to the i-th sub-frame is $(2^{i-1}/2^7)*T/8$, wherein i is greater than or equal to 1, less than or equal to 8.

Wherein the step of according to values in a j-th sub-frame, using a driving time corresponding to the j-th sub-frame to drive thin-film transistors (TFT) in a display panel to turn on or turn off includes: reading values in the j-th sub-frame in a row-by-row method, the display panel controls the TFTs to turn on or turn off in the driving time corresponding to the j-th sub-frame.

Or, reading values in the j-th sub-frame in a row-by-row method, and in a situation that values in the j-th sub-frame are all obtained, the display panel controls the TFTs to turn on or turn off in the driving time corresponding to the j-th sub-frame.

Wherein after values in the j-th sub-frame are all obtained, and after a preset time, the display panel controls the TFTs to turn on or turn off in the driving time corresponding to the j-th sub-frame in order to adjust a turn-on time or a turn-off time of the TFT on the display panel.

A driving display device, wherein the driving display device includes units as the methods claimed in anyone of claim 1 to claim 9.

The embodiments of the present invention will have the following beneficial effects: in the AMOLED pixel circuit, the OLED current (Ioled) is not linearly related to Vgs and Vth of the driving TFT, and the Vth of the driving TFT may drift over time, resulting in a change in the Ioled, and an overall uneven brightness of the AMOLED panel. A digital control driving method and a driving display device are disclosed such that the source driver IC only output two grayscale voltages so as to effectively avoid a drift of the Vth of the driving TFT such that an entire brightness of the AMOLED panel is even to improve the display quality.

BRIEF DESCRIPTION OF THE DRAWINGS

In order to more clearly illustrate the technical solution in the present invention or in the prior art, the following will illustrate the figures used for describing the embodiments or the prior art. It is obvious that the following figures are only some embodiments of the present invention. For the person of ordinary skill in the art without creative effort, it can also obtain other figures according to these figures.

DETAILED DESCRIPTION OF THE PREFERRED EMBODIMENT

The following content combines with the drawings and the embodiment for describing the present invention in detail. It is obvious that the following embodiments are only some embodiments of the present invention. For the person of ordinary skill in the art without creative effort, the other embodiments obtained thereby are still covered by the present invention.

In order to better understanding the principle of using the PWM-controlled driving method to avoid the Vth drift of the TFT disclosed in the embodiment of the present invention, a flow chart of a digital control driving method provided first to describe an embodiment of the present invention in detail.

Figure 1:
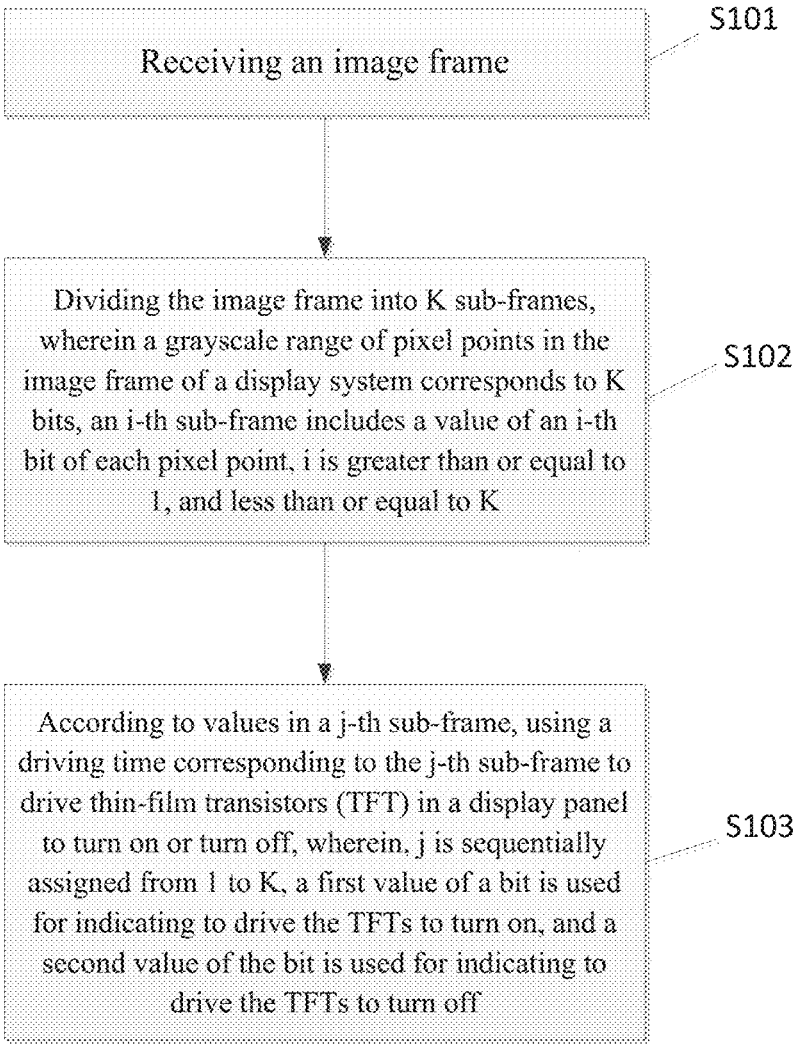
FIG. 1 is a flow chart of a digital control driving method provided by an embodiment of the present invention.

With reference to FIG. 1, FIG. 1 is a flow chart of a digital control driving method provided by an embodiment of the present invention. As shown in FIG. 1, the digital control driving method provided by an embodiment of the present invention includes:

S101: receiving an image frame.

Wherein, receiving an image frame by a logic board TCON, mainly receiving image data included in the image frame.

Optionally, the image frame is a two-dimensional plane image frame or a 3D image frame, wherein, the 3D image frame includes a 3D left-eye image frame and a 3D right-eye image frame.

S102: dividing the image frame into K sub-frames, wherein a grayscale range of pixel points in the image frame of a display system corresponds to K bits, an i-th sub-frame includes a value of an i-th bit of each pixel point, i is greater than or equal to 1, and less than or equal to K.

Wherein, if the image frame is a 3D image frame, the step of dividing the image frame into K sub-frames is respectively to divide a 3D left-eye image frame and a 3D right-eye image frame into K sub-frames.

It can be understood that, the number of the sub-frames K divided from the image frame is corresponds to a grayscale range of the pixel point in the image frame. Specifically, if the grayscale range of the display system is 0-255, a grayscale value of each pixel point is within 0-255. The grayscale value of each pixel point is represented by a binary form, that is, the grayscale value of each pixel point can be represented by 8 bits in the binary form. A first bit of the grayscale value of each pixel point corresponds to sub-frame 1, a second bit of the grayscale value of each pixel point corresponds to sub-frame 2, dividing sequentially, and the image frame is divided into 8 sub-frames. That is, the value of K is 8. It should be noted that in the binary form, only two types of values of 0 or 1 is existed. That is, in each sub-frame only two values of 0 and 1 is existed. The two values correspond to two states of the pixel point. When the value of the bit of a sub-frame is 0, the pixel point corresponds to that bit does not emit a light, when the value of the bit of a sub-frame is 1, the pixel point corresponds to that bit emit a light.

Figure 2:
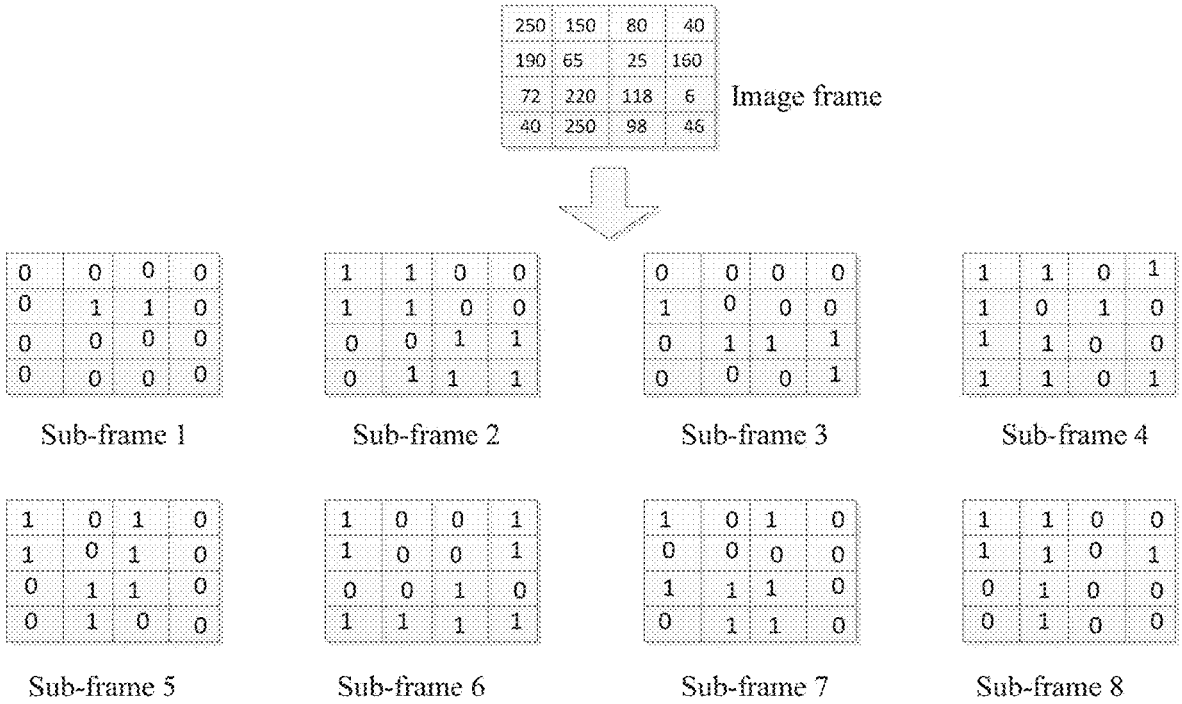
FIG. 2 is a schematic diagram of a relationship between the grayscale bits and the sub-frames.

To illustrate the relation between the number of the sub-frames K and the grayscale range of the pixel point in the image frame, with reference to FIG. 2, FIG. 2 is a schematic diagram of a relationship between the grayscale bits and the sub-frames. As shown in FIG. 2, the grayscale range of the display system is 0-255, and the image frame includes 16 pixel points. Each pixel point has one grayscale value. For example, the grayscale value of the pixel point at top left corner is 250, and can be represented as 11111010 in the binary form. The grayscale value of the pixel point at top right corner is 40, and can be represented as 00101000 in the binary form, and the grayscale value of the remaining pixel point is also represented as the binary form. First bits of the grayscale values of all pixel points (have been represented as the binary form) form the sub-frame 1, and second bits form the sub-frame 2, and so on. The eighth bits form the sub-frame 8.

It can be understood that values of each pixel point in each sub-frame is only 0 or 1. For example, the value of the pixel point at left top corner of the sub-frame 1 is 0, corresponding to the first bit of the pixel point having the grayscale value of 250. The value of the pixel point at right top corner of the sub-frame 1 is 0, corresponding to the first bit of the pixel point having the grayscale value of 40. The value of the pixel point at left top corner of the sub-frame 8 is 1, corresponding to the eighth bit of the pixel point having the grayscale value of 250. In all sub-frame, if the value of a pixel point is 0, an OLED corresponding to the pixel point does not emit a light, if the value of a pixel point is 1, an OLED corresponding to the pixel point emits a light.

It can be understood that if the grayscale range of the display system is not 0-255, but another range such as 0-511, the above method can also be adopted. Dividing an image frame into sub-frames according to the number of the bits, the values in each sub-frame are only 0 and 1. The value 0 represents that an OLED corresponding to the pixel point does not emit a light, and the value 1 represents that an OLED corresponding to the pixel point emits a light, no more repeating.

Specifically, after dividing an image frame into K sub-frames according to the number of the bits, an occupied time of each K sub-frame is the same, but driving times of the K sub-frames are different. Specifically, a period of a frame is T, the occupied time of each K sub-frame is K/T. when the grayscale range of the display system is 0-255, the driving time corresponding to i-th sub-frame is $(2^{i-1}/2^7)*T/8$. Wherein, i is greater than or equal to 1, and less than or equal to K. Here, the K sub-frames are assigned with different driving times is to simulate a display effect of the grayscale value of the pixel point in original image frame. For example, if the grayscale value of the pixel point of the original pixel frame is 100. However, after diving into sub-frame, the values of the pixel point in each sub-frame is only 0 and 1, corresponding to emit a light or not emit a light. Through assigning different sub-frames with different driving times, controlling emitting times of different sub-frames, a display effect of the grayscale value of 100 can be simulated.

Figure 3:
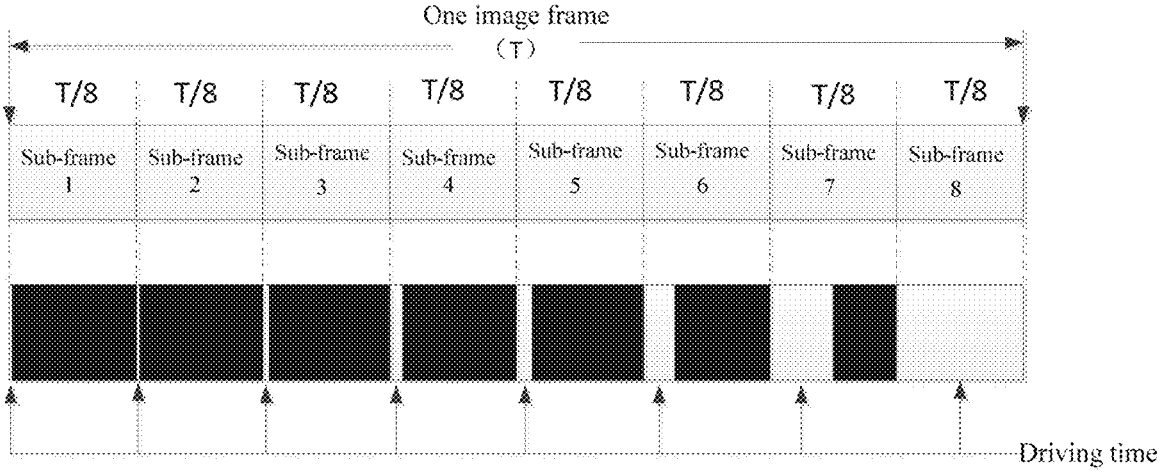
FIG. 3 is a schematic diagram of a relationship between driving times and sub-frames according to an embodiment of the present invention.

With reference to FIG. 3, FIG. 3 is a schematic diagram of a relationship between driving times and sub-frames according to an embodiment of the present invention. Here, a period of one image frame is T, the grayscale range is 0-255 so that 8 sub-frames are divided. An occupied time of each sub-frame is T/8, a driving time of sub-frame 1 is $(2^0/2^7)*T/8$, and a corresponding emitting time is also $(2^0/2^7)*T/8$. A driving time of sub-frame 2 is $(2^2/2^7)*T/8$, and a corresponding emitting time is also $(2^0/2^7)*T/8$. And so on, a driving time of sub-frame 8 is T/8, and a corresponding emitting time of the sub-frame 8 is longest to be T/8.

It can be understood that another method or assignment method for the driving time can also be adopted to reach the display effect of the grayscale value. The above method is only a preferred embodiment. Using another method or assignment method for the driving time to reach the display effect of the grayscale value is also covered by the scope of the present invention.

It can be understood that after diving the image frame into K sub-frames, the value of each pixel in each sub-frame can only be 0 or 1. When driving AMOLED panel to display, driving a TFT to operate in turned-on or turned-off state. The source driver IC only output two grayscale voltages so as to effectively avoid a drift of the Vth of the driving TFT such that an entire brightness of the AMOLED panel is even to improve the display quality.

S103: according to values in a j-th sub-frame, using a driving time corresponding to the j-th sub-frame to drive thin-film transistors (TFT) in a display panel to turn on or turn off, wherein, j is sequentially assigned from 1 to K, a first value of a bit is used for indicating to drive the TFTs to turn on, and a second value of the bit is used for indicating to drive the TFTs to turn off.

Wherein, if using a binary to represent the grayscale value, the first value represents that the value of a pixel point in a sub-frame is 1, indicating the driving TFT to turn on, the second value represents that the value of a pixel point in a sub-frame is 0, indicating the driving TFT to turn on.

Optionally, if the image frame is a 3D image frame, according to values in the j-th sub-frame of the 3D left-eye image frame, using a driving time corresponding to j-th sub-frame to drive TFTs in the display panel to turn on or turn off, wherein j is sequentially assigned from 1 to K; after the 3D left-eye image frame finishes driving and displaying, according to values in the j-th sub-frame of 3D right-eye image frame, using a driving time corresponding to the j-th sub-frame to drive TFTs in the display panel to turn on or turn off, wherein j is sequentially assigned from 1 to K.

The above transmission driving method of the sub-frames belongs to a sequential transmission driving. It can be understood that transmitting K sub-frames corresponding to 3D left-eye image frame to the display panel, the transmission sequence of the sub-frame is from sub-frame 1 to sub-frame K. Then, the display panel drives the TFT to turn on or turn off according to a driving time corresponding to each sub-frame. After the 3D left-eye image frame finish driving and displaying, using the same method to drive and display the 3D right-eye image frame.

Figure 4A:
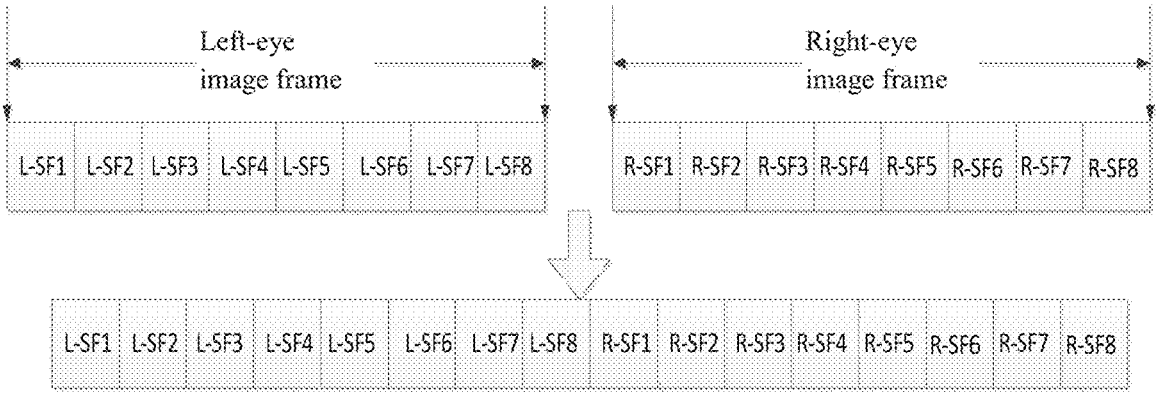
FIG. 4A is a schematic diagram of a transmission sequence of sub-frames according to an embodiment of the present invention.

For understanding, with reference to FIG. 4A, FIG. 4A is a schematic diagram of a transmission sequence of sub-frames according to an embodiment of the present invention. When the grayscale range of the display system is 0-255, the 3D left eye image frame and the 3D right eye image frame are respectively divided into 8 sub-frames, and respectively corresponding to L-SF1, L-SF2, . . . L-SF8 and R-SF1, R-SF2, . . . R-SF8. In the driving displaying, in one frame period, sequentially transmitting L-SF1, L-SF2, . . . L-SF8, in a next frame period, transmitting R-SF1, R-SF2, . . . R-SF8.

Optionally, if the image frame is a 3D image frame, according to values in the j-th sub-frame of the 3D left-eye image frame, using a driving time corresponding to j-th sub-frame to drive TFTs in the display panel to turn on or turn off, after the j-th sub-frame of the 3D left-eye image frame drives the TFTs in the display panel to turn on or turn off, according to values in the j-th sub-frame of 3D right-eye image frame, using a driving time corresponding to the j-th sub-frame to drive TFTs in the display panel to turn on or turn off, wherein j is sequentially assigned from 1 to K.

Figure 4B:
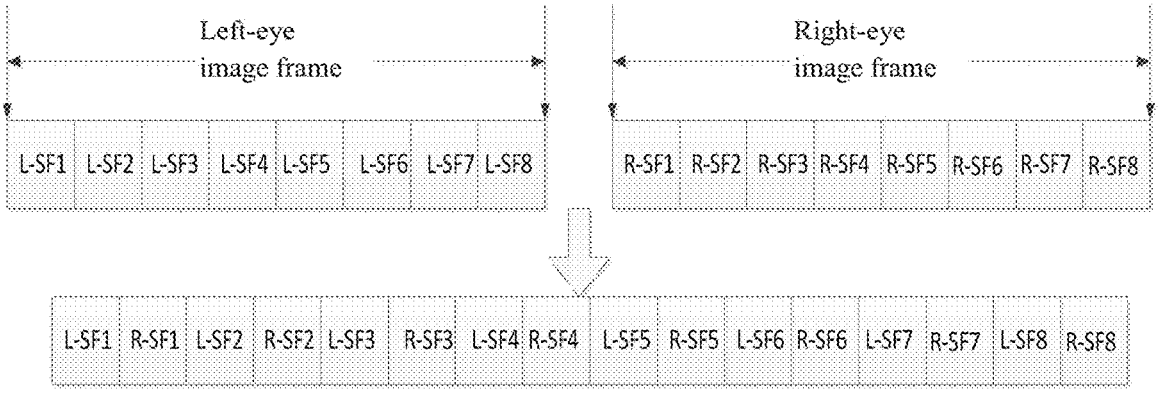
FIG. 4B is a schematic diagram of a transmission sequence of sub-frames according to an embodiment of the present invention.

The above transmitting method for sub-frames belongs to an alternately transmitting and driving. It can be understood that alternately transmitting K/2 sub-frames corresponding to the 3D left-eye image frame and the 3D right-eye image frame. The transmitting sequence is from sub-frame 1 to sub-frame K/2, and alternately transmitting. Then, the display panel controls the TFTs to turn on or turn off in the driving time corresponding to each sub-frame. After driving and displaying previous K/2 sub-frames corresponding to the 3D left-eye image frame and the 3D right-eye image frame, alternately transmitting following K/2 sub-frames corresponding to the 3D left-eye image frame and the 3D right-eye image frame. The transmitting sequence is from sub-frame K/2 to sub-frame K, alternately transmitting, and the display panel controls the TFTs to turn on or turn off in the driving time corresponding to the each sub-frame For understanding, with reference to FIG. 4B, FIG. 4B is a schematic diagram of a transmission sequence of sub-frames according to an embodiment of the present invention. When the grayscale range of the display system is 0-255, the 3D left eye image frame and the 3D right eye image frame are respectively divided into 8 sub-frames, and respectively corresponding to L-SF1, L-SF2, . . . L-SF8 and R-SF1, R-SF2, . . . R-SF8. In the driving displaying, in one frame period, sequentially transmitting L-SF1, L-SF2, . . . L-SF8, in a next frame period, transmitting R-SF1, R-SF2, . . . R-SF8.

It should be noted that assuming that a frequency of the 3D image is 60 Hz, each of the left-eye image frame and the right-eye image frame occupies 8.3 ms. A switching between the left-eye image frame and the right-eye image frame at least requires 8.3 ms. However, through dividing the left-eye image frame and the right-eye image frame into sub-frames. For example, when the grayscale range of the display system 0-255, each of the left-eye image frame and the right-eye image frame is divided into 8 sub-frames, each sub-frame occupies 1 ms so that a switching between the left-eye image frame and the right-eye image frame only requires 1 ms so as to effectively decrease a discomfort because of too long interval of bright and dark.

Wherein, the entire controlling and driving process is based on sub-frame. Each sub-frame includes a fastest charging time T_charge, a fastest discharging time T_discharge. A lighting up time T display and a non-lighting up time T blank. The T display is based on the sequence number of the sub-frame. Different sub-frames correspond to different T display. The T_charge and the T_discharge can be specifically adjusted according to different sub-frames.

Specifically, when driving the sub-frame to display, using a row-by-row method to read the data of the sub-frame from the first row to a last row.

Optionally, reading values in the j-th sub-frame in a row-by-row method, and in a situation that values in the j-th sub-frame are all obtained, the display panel controls the TFTs to turn on or turn off in the driving time corresponding to the j-th sub-frame. Specifically, after a logic board TCON finishes a row scanning to the sub-frame, reading the data of the sub-frame. Because each sub-frame only includes two values of 0 or 1, TCON correspondingly generates two voltages values and transmits to the display panel. The display panel receives the voltages and converting into driving voltages, and according to the driving time corresponding to the sub-frame to sequentially drive the TFTs to turn on in a row-by-row method, lighting up corresponding pixel point.

Figure 5A:
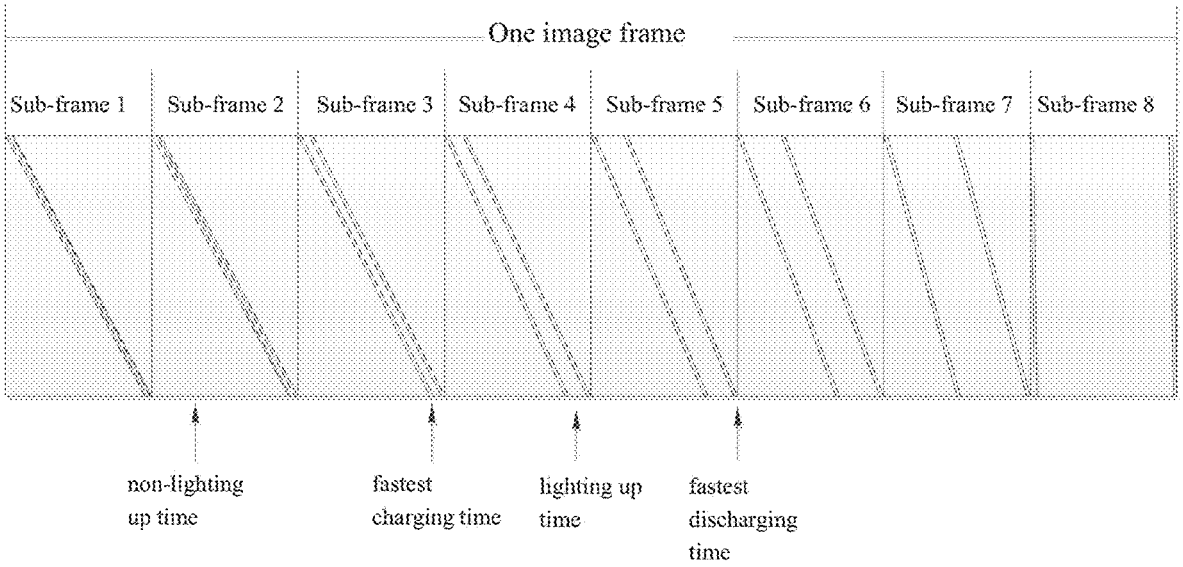
FIG. 5A is a schematic diagram of a scanning driving method of a sub-frame according to an embodiment of the present invention.

It can be understood that, with reference to FIG. 5A, FIG. 5A is a schematic diagram of a scanning driving method of a sub-frame according to an embodiment of the present invention. The grayscale range of the display system is 0-255, the left/right eyes image frames are respectively divided into 8 sub-frames, each sub-frame uses a row-by-row scanning method to scan from a first row to a last row in one eighth of the 3D image frame period, and correspondingly lighting up the pixel points of each row. Wherein, the lighting up times of rows of each sub-frame are different.

Optionally, reading values in the j-th sub-frame in a row-by-row method, and in a situation that values in the j-th sub-frame are all obtained, the display panel controls the TFTs to turn on or turn off in the driving time corresponding to the j-th sub-frame. Specifically, after the logic board TCON finishes a row scanning for the sub-frame, reading the data of the sub-frame, transmitting display data required by each row to the display panel, and latched at the pixel point. After scanning all rows of the entire sub-frame, according to driving times corresponding to sub-frame to simultaneously drive all TFTs on the display panel to turn on, lighting up corresponding pixel points.

Figure 5B:
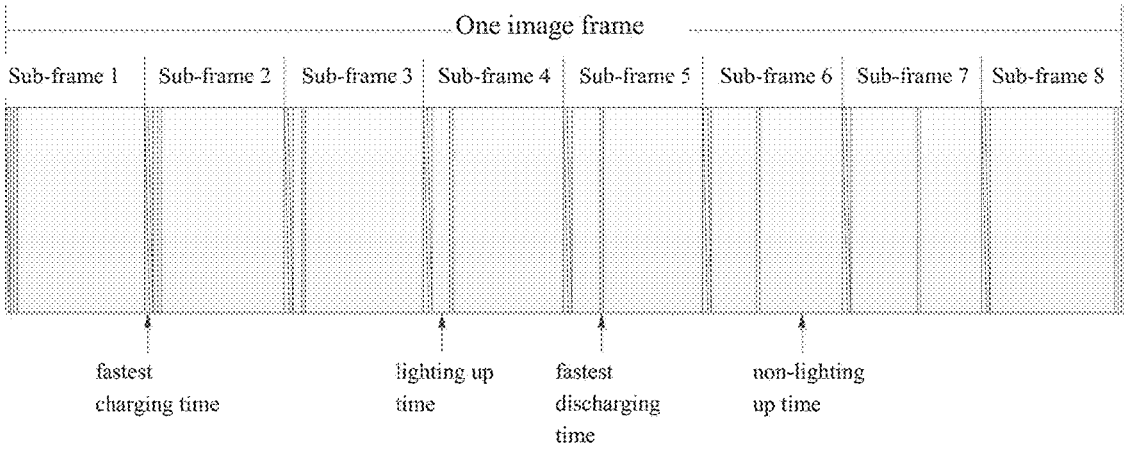
FIG. 5B is a schematic diagram of a scanning driving method of a sub-frame according to an embodiment of the present invention.

With reference to FIG. 5B, FIG. 5B is a schematic diagram of a scanning driving method of a sub-frame according to an embodiment of the present invention. The grayscale range of the display system is 0-255, the left/right eyes image frames are respectively divided into 8 sub-frames, each sub-frame uses a row-by-row scanning method to scan from a first row to a last row in one eighth of the 3D image frame period, and correspondingly lighting up the pixel points of each row. After scanning all rows of the entire sub-frame, according to driving times corresponding to sub-frame to simultaneously drive all TFTs on the display panel to turn on, lighting up corresponding pixel points. Wherein, lighting up times are different based on sub-frames, after lighting up time corresponding to each sub-frame, discharging all scanning rows simultaneously.

It should be note that after values in the j-th sub-frame are all obtained, and after a preset time, the display panel controls the TFTs to turn on or turn off in the driving time corresponding to the j-th sub-frame in order to adjust a turn-on time or a turn-off time of the TFT on the display panel, wherein the preset time can be set according to a requirement.

Specifically, in the method that scanning the sub-frame row-by-row, and simultaneously lighting up, a starting moment for lighting up can be adjusted on a timeline. However, a minimum time requirement for T_charge and T_discharge should be satisfied. That is, a minimum time requirement for charging a voltage of a row of pixels to a corresponding grayscale voltage, and a minimum time requirement for discharging a pixel voltage to a low voltage. It can be understood that in this way, a control signal and pixel circuit that can simultaneously driving, lighting up and discharging are required. The specific pixel circuit is not under the scope of the present application, no more describing in detail.

Wherein, for different scanning lines, a random scan can be used for scanning. Specifically, the scanning of each sub-frame will be shifted on the timeline according to a specific time period. In particular, the shift based on sub-frame may be based on a single scanning line or multiple scanning line groups. For a certain scan line or a group of scanning lines, the order of sub-frame transmission is fixed. For example, dividing all the scanning lines into groups A, B, C, and D. From a time to, if sequential scans are performed, then the groups A, B, C, and D are scanned in the order of sub-frames 1, 2, 3, and 4. If a random scan is adopted, group A scans in sub-frame order 1, 2, 3, 4; group B scans in sub-frame order 4, 1, 2, 3; group C scans in sub-frame order 3, 4, 1, 2 and group D scans in sub-frames 2, 3, 4, and 1.

Figure 6:
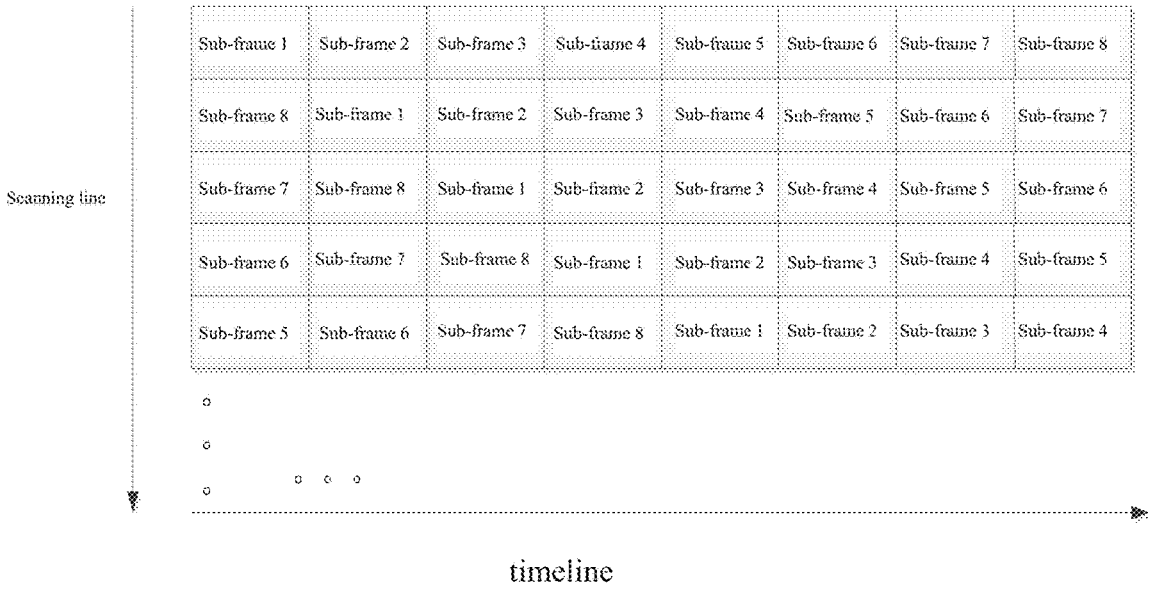
FIG. 6 is a random scanning method of sub-frames according to an embodiment of the present invention.

For understanding, with reference to FIG. 6, FIG. 6 is a random scanning method of sub-frames according to an embodiment of the present invention. Wherein, a horizontal axis represents a timeline, a vertical axis represents different scanning lines, the scanning lines can be a single scanning line or multiple group, and the number of sub-frames is 8. As shown in FIG. 6, for different scanning lines, scanning and displaying sequence for the 8 sub-frames are different. From the horizontal axis, for a scanning line or a group of scanning line, the transmitting sequence of the sub-frames is fixed. However, from the vertical axis, the scanning of each sub-frame is shifted on the timeline according to a specific time period It can be shown that when a random scanning method for scanning and displaying is adopted, a pseudo-contour or dynamic artifact issues because of multiple sub-frames are sequentially displayed when driving to display a 3D left-eye image frame and a 3D right-eye image frame can be effectively avoided.

Figure 7A:
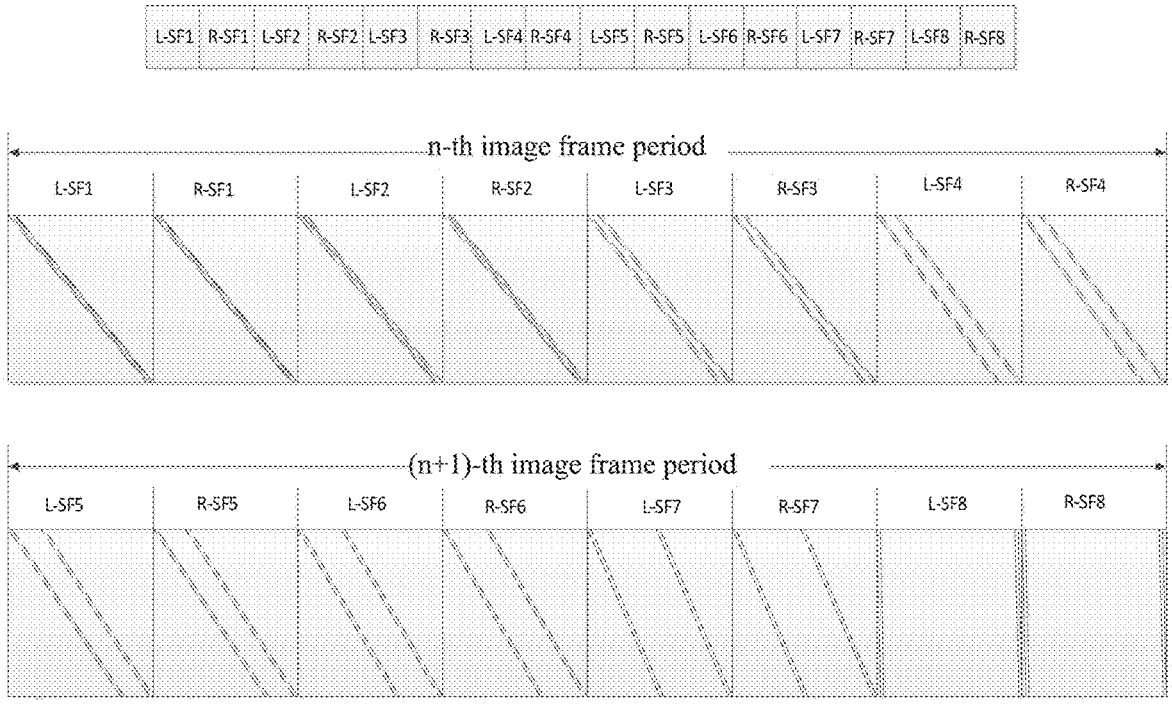
FIG. 7A is a schematic diagram of lighting up by driving row-by row and alternatively transmitted of sub-frames according to an embodiment of the present invention.

Optionally, in a possible embodiment of the present invention, the transmission and scanning method of the sub-frames can be combined in order to finish driving and displaying. With reference to FIG. 7A, FIG. 7A is a schematic diagram of lighting up by driving row-by row and alternatively transmitted of sub-frames according to an embodiment of the present invention. In the time of an n-th image frame, previously 4 sub-frames corresponding to the n-th frame 3D left-eye image frame and the n-th frame 3D right-eye image frame are alternately transmitted to the display panel, and the sub-frame transmission sequence is from sub-frame 1 to sub-frame 4. Progressively scanning the previously 4 sub-frames corresponding to the left-eye image frame and the previously 4 sub-frames corresponding to the right-eye image frame. In the time of the (n+1)-th image frame, the subsequent 4 sub-frames corresponding to the n-th frame 3D left-eye image frame and the n-th frame 3D right-eye image frame are alternately transmitted to the display panel. The sub-frame transmission sequence is from sub-frame 5 to sub-frame 8, and the subsequent 4 sub-frames corresponding to the left-eye image frame and the subsequent 4 sub-frames corresponding to the right-eye image frame are scanned one by one, and are driven according to the corresponding driving times of the sub-frames to light up in a row-by-row manner.

Figure 7B:
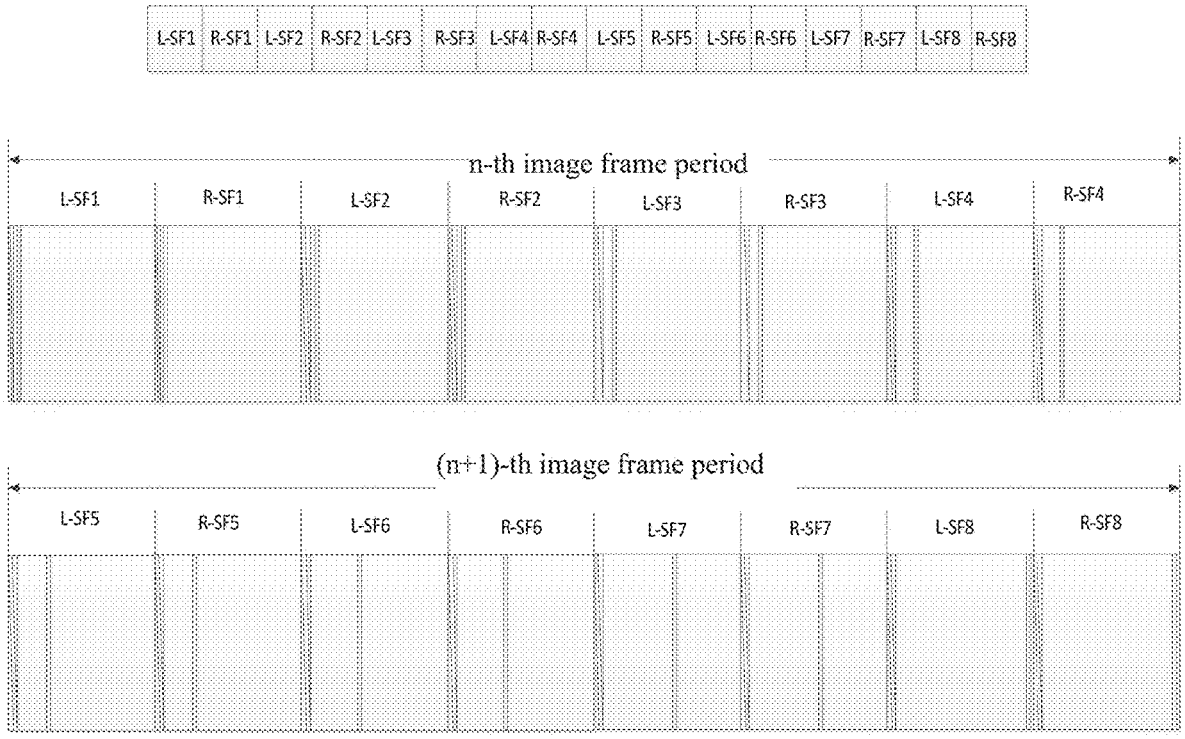
FIG. 7B is a schematic diagram of lighting up simultaneously and alternatively transmitted of sub-frames according to an embodiment of the present invention.

With reference to FIG. 7B, FIG. 7B is a schematic diagram of lighting up simultaneously and alternatively transmitted of sub-frames according to an embodiment of the present invention. In the time of an n-th image frame, previously 4 sub-frames corresponding to the n-th frame 3D left-eye image frame and the n-th frame 3D right-eye image frame are alternately transmitted to the display panel, and the sub-frame transmission sequence is from sub-frame 1 to sub-frame 4. Progressively scanning the previously 4 sub-frames corresponding to the left-eye image frame and the previously 4 sub-frames corresponding to the right-eye image frame. Then, the display data required by each row are transmitted to the display panel and latched to the pixel point. In the time of the (n+1)-th image frame, the subsequent 4 sub-frames corresponding to the n-th frame 3D left-eye image frame and the n-th frame 3D right-eye image frame are alternately transmitted to the display panel. The sub-frame transmission sequence is from sub-frame 5 to sub-frame 8, and the subsequent 4 sub-frames corresponding to the left-eye image frame and the subsequent 4 sub-frames corresponding to the right-eye image frame are scanned in a row-by-row manner. The required display data of each row is transmitted to the display panel and latched to the pixels, and then all the pixels are driven to light up at the same time according to the drive time corresponding to the sub-frame.

It can be understood that for a 3D image frame, a certain non-light time is required when switching between the 3D left-eye image frame and the 3D right-eye image frame, and the above-mentioned image sub-frames alternately transmitted and simultaneously driving the lighting mode, a non-lighting time is existed when switching from the left-eye image frame sub-frame to the right-eye image frame sub-frame. Therefore, extra design is not required and a relatively large light-emitting duty cycle is obtained. In addition, since the left-eye image frame and the right-eye image frame are divided into sub-frames, when the grayscale range of the display system is 0-255 and the 3D image frame rate is 60 Hz, averagely, a sub-frame will be displayed in 1 ms. The present invention can help the user to effectively reduce the discomfort caused by the light/dark display interval being too long.

Of course, in addition to the above combination of the transmission mode and the scanning mode, other combinations such as the combination of image sub-frame sequential transmission and simultaneous drive lighting or combination of image sub-frame sequential transmission and progressive drive lighting may be used, and the principle is similar to the above method, no more repeating here.

As discussed above, the sub-frames are divided and the 3D image frame display is driven by PWM control. The driving TFT only works in two states, turned-on or turned-off, so that the source driver chip only outputs two grayscale voltage values, which can effectively avoid the affection of the Vth drift of driving TFT and improve display quality.

Figure 8:
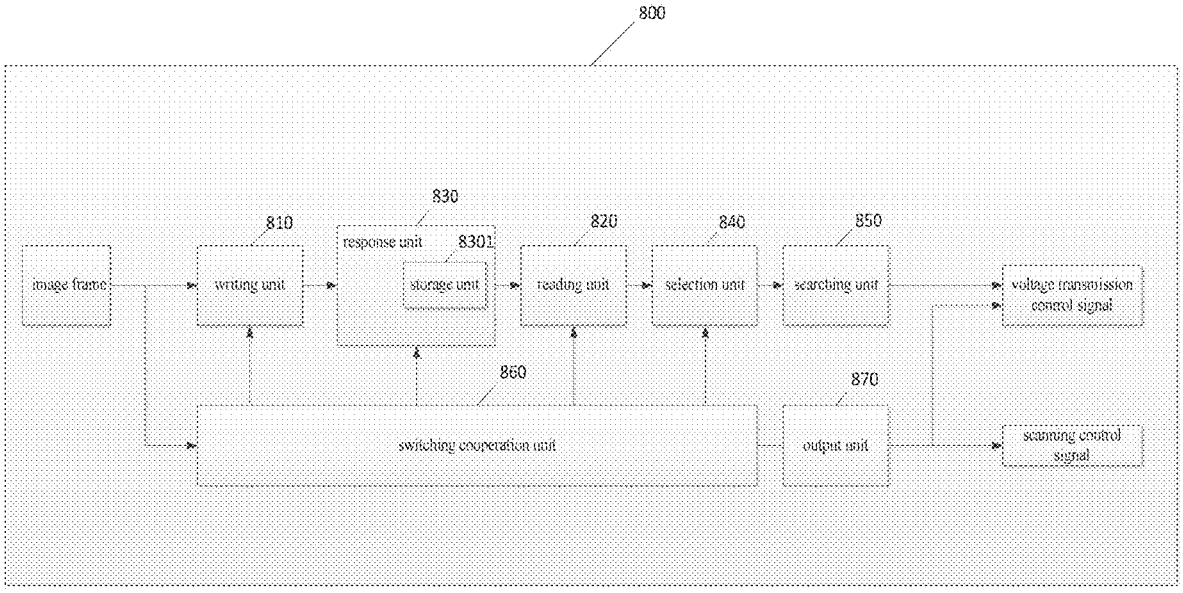
FIG. 8 is a schematic structural diagram of a driving display control device TCON according to an embodiment of the present invention.

Corresponding to the digital control driving method described above, the present application further provides a driving display control device TCON. With reference to FIG. 8, FIG. 8 is a schematic structural diagram of a driving display control device TCON according to an embodiment of the present invention.

The driving display control device 800 includes: a writing unit 810, a reading unit 820, a response unit 830, a selection unit 840, a searching unit 850, a switching cooperation unit 860, and an output unit 870.

The writing unit 810 is configured to receive data of an image frame and divide the image frame into sub-frames, and is also responsible for a writing request of the data of the image frame to the frame buffering device and writing the data arrangement.

Optionally, the image frame may be a two-dimensional planar image frame or a 3D image frame. The 3D image frame includes a 3D left-eye image frame and a 3D right-eye image frame.

A reading unit 820 is used to read out the data of the image frame from the frame buffering device and read out the data arrangement.

It should be noted that, if the image frame is a 3D image frame, the reading of the image frame data is determined by the transmission mode of the image frame. For example, in the alternate transmission mode, a certain sub-frame corresponding to the left-eye image frame is read first. Then, reading the sub-frame corresponding to the right-eye image frame. It can be understood that different transmission methods correspond to different image frame data reading methods, which are not described herein.

The response unit 830 is configured to respond to the write and read requests, store the writing data in the frame buffering device, read the data from the frame buffering device, and manage the storage area of the image frame data; the response unit 830 further includes a storage unit 8301. The storage unit 8301 is configured to store image frame data in a frame-based manner.

The selection unit 840 is used for selecting a sub-frame, and according to the current sub-frame, selects the corresponding bits from the read data. Specifically, after the image frame is divided into sub-frames, there is only one bit corresponding to a certain pixel data, but when the sub-frame data is stored in the frame buffering device, the data is combined into a plurality of frames according to the specifications of the frame buffering device such as 16 bit, 32 bit, etc. Here, selecting bits refers to selecting corresponding bits according to the position of the current pixel point from the plurality of bits.

The searching unit 850 is used for searching for data of the sub-frame of the image frame.

The switching cooperation unit 860 is used to control the generation of the sub-frame switching signal and at the same time, responsible for the cooperation of other units.

The output unit 870 cooperates with the data stream to generate a scanning control signal GD and a voltage transmission control signal SD. The scanning control signal GD is used to control scanning rows of the image frame. The voltage transmission control signal SD is used to control the transmission of the grayscale voltage of each pixel point in each row. In the digital control driving mode, the voltage transmission control signal SD controls the source driving chip to output only two grayscale voltage values, corresponding to drive the driving TFT to turn on or turn off.

As discussed above, when driving and displaying an image frame, the image frame is divided into sub-frames, stored and read out. Besides, through the selection of the sub-frames, and according to the current sub-frame, the corresponding bits are selected from the read data. The scan control signal GD and the voltage transmission control signal SD are generated in conjunction with the image data stream, so that the source driver chip only outputs two grayscale voltages, there will not be multiple grayscale voltages, so that the pixel circuit drives the TFT in the display panel only works at the turned-on or turned-off states. The present invention, can effectively avoid the impact of the inconsistency of the panel brightness caused by the Vth drift of the driving TFT, and the entire drive display control device TCON is simple in structure, the driving becomes more efficient and simple.

Based on the same inventive concept, an embodiment of the present invention provides a display device, wherein the display device adopts any of the driving display control devices as the driving display control device described in the above embodiments, and the display device may be: LCD panels, electronic paper, OLED panels, mobile phones, tablet computers, televisions, monitors, notebook computers, digital photo frames, navigation devices, and other products or components with display capabilities.

Because the display device provided by the embodiment of the present invention has the same technical features as anyone of the drive display control devices provided by the above embodiments so that the same technical problems can also be solved and the same technical effects can be achieved.

Figure 9:
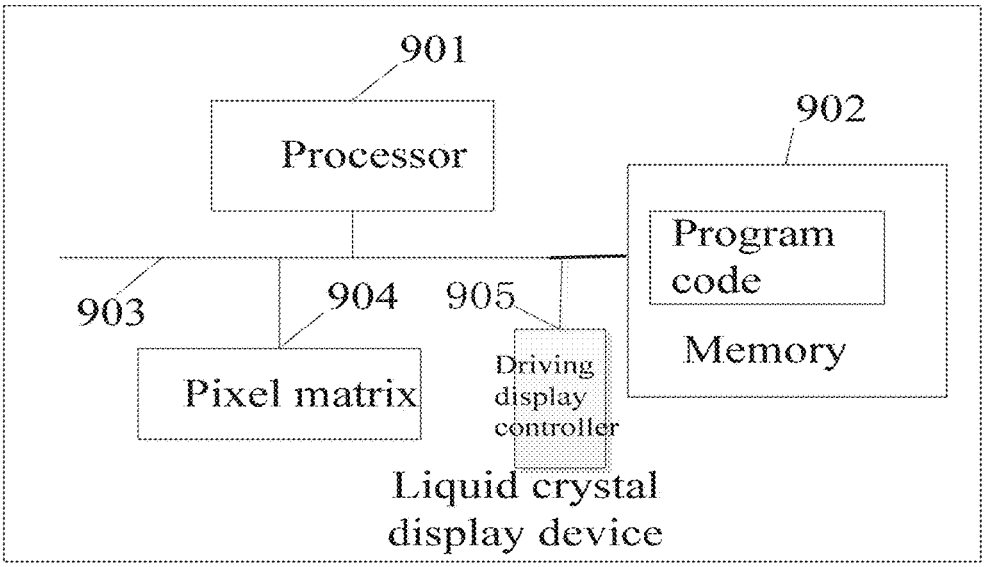
FIG. 9 is a schematic diagram of a liquid crystal display device according to an embodiment of the present invention.

Based on the flow chart of a digital control driving method shown in FIG. 1 and the structure diagram of a driving display control device TCON shown in FIG. 8, with reference to FIG. 9. FIG. 9 is a schematic diagram of a liquid crystal display device according to an embodiment of the present invention. As shown in FIG. 9, the liquid crystal display device may include: at least one processor 901 (for example, a CPU), a memory 902, at least one communication bus 903, a pixel matrix 904, and a driving display controller 905. Wherein, the communication bus 903 is used to realize connection communication between these components. The memory 902 may be a high speed RAM memory, and may also be a non-volatile memory such as at least one disk memory. The memory 902 may optionally include at least one memory device located away from the aforementioned processor 901. The pixel matrix 904 is used to display images. The display controller 905 is driven to receive image frames and divide the sub-frames to generate a scanning control signal GD and voltage transmission control signal SD.

A person of ordinary skill in the art may understand that all or some of the various methods in the above embodiments may be instructed by a program to refer to related hardware. The program may be stored in a computer-readable storage medium. The storage medium may include: flash disk, Read-Only Memory (ROM), Random Access Memory (RAM), disk or optical disk, etc.

The above embodiments of the present invention provide an illustration for a digital control driving method, a driving display device and a display device in detail. Specific examples are used herein to describe the principle and implementation manner of the present invention. The above embodiments are only used to help understanding the method and the core idea of the present invention; at the same time, for those skilled in the art, according to the present invention, the embodiments of the present invention will have changes in specific implementation manners and application ranges. In summary, the contents of this specification should not be construed as limiting the present invention.

What is claimed is:

1. A digital control driving method, comprising steps of:

receiving an image frame;

dividing the image frame into K sub-frames, K being a positive integer, wherein a grayscale range of pixel points in the image frame of a display system corresponds to K bits, wherein an i-th sub-frame includes a value of an i-th bit of each pixel point, where i is greater than or equal to 1 and less than or equal to K; and according to values in a j-th sub-frame, using a driving time corresponding to the j-th sub-frame to drive thin-film transistors (TFT) in a display panel to turn on or turn off;

wherein j is sequentially assigned from 1 to K, and a first value of a bit is used for indicating to drive the TFTs to turn on and a second value of the bit is used for indicating to drive the TFTs to turn off; and wherein the image frame is equally divided into the K sub-frames, such that in one frame period of the image frame, the K sub-frames of the image frame have the same occupied time.

2. The digital control driving method according to claim 1, wherein the image frame includes a 3D image frame, and the 3D image frame includes a 3D left-eye image frame and a 3D right-eye image frame.

3. The digital control driving method according to claim 2, wherein the step of dividing the image frame into K sub-frames includes:

respectively dividing the 3D left-eye image frame and the 3D right-eye image frame into K sub-frame;

wherein the step of according to values in a j-th sub-frame, using a driving time corresponding to the j-th sub-frame to drive thin-film transistors (TFT) in a display panel to turn on or turn off includes:

according to values in the j-th sub-frame of the 3D left-eye image frame, using a driving time corresponding to j-th sub-frame to drive TFTs in the display panel to turn on or turn off, wherein j is sequentially assigned from 1 to K; and after the 3D left-eye image frame finishes driving and displaying, according to values in the j-th sub-frame of 3D right-eye image frame, using a driving time corresponding to the j-th sub-frame to drive TFTs in the display panel to turn on or turn off, wherein j is sequentially assigned from 1 to K.

4. The digital control driving method according to claim 2, wherein the step of dividing the image frame into K sub-frames includes:

respectively dividing the 3D left-eye image frame and the 3D right-eye image frame into K sub-frame;

wherein the step of according to values in a j-th sub-frame, using a driving time corresponding to the j-th sub-frame to drive thin-film transistors (TFT) in a display panel to turn on or turn off includes:

according to values in the j-th sub-frame of the 3D left-eye image frame, using a driving time corresponding to j-th sub-frame to drive TFTs in the display panel to turn on or turn off, wherein j is sequentially assigned from 1 to K; and after the j-th sub-frame of the 3D left-eye image frame drives the TFTs in the display panel to turn on or turn off, according to values in the j-th sub-frame of 3D right-eye image frame, using a driving time corresponding to the j-th sub-frame to drive TFTs in the display panel to turn on or turn off, wherein j is sequentially assigned from 1 to K.

5. The digital control driving method according to claim 1, wherein driving times of the K sub-frames are different.

6. The digital control driving method according to claim 5, wherein if a grayscale range of the display system is 0-255, K is equal to 8, the one frame period of the image frame is T, a driving time corresponding to the i-th sub-frame is $(2^{i-1}/2^7)*T/8$, wherein i is greater than or equal to 1, less than or equal to 8.

7. The digital control driving method according to claim 1, wherein the step of according to values in a j-th sub-frame, using a driving time corresponding to the j-th sub-frame to drive thin-film transistors (TFT) in a display panel to turn on or turn off includes:

reading values in the j-th sub-frame in a row-by-row method, the display panel controls the TFTs to turn on or turn off in the driving time corresponding to the j-th sub-frame.

8. The digital control driving method according to claim 1, wherein the step of according to values in a j-th sub-frame, using a driving time corresponding to the j-th sub-frame to drive thin-film transistors (TFT) in a display panel to turn on or turn off includes:

reading values in the j-th sub-frame in a row-by-row method, and in a situation that values in the j-th sub-frame are all obtained, the display panel controls the TFTs to turn on or turn off in the driving time corresponding to the j-th sub-frame.

9. The digital control driving method according to claim 8, wherein after values in the j-th sub-frame are all obtained, and after a preset time, the display panel controls the TFTs to turn on or turn off in the driving time corresponding to the j-th sub-frame in order to adjust a turn-on time or a turn-off time of the TFT on the display panel.

10. A driving display device, comprising:

a receiving unit used for receiving an image frame;

a dividing unit used for dividing the image frame into K sub-frames, K being a positive integer, wherein a grayscale range of pixel points in the image frame of a display system corresponds to K bits, wherein an i-th sub-frame includes a value of an i-th bit of each pixel point, i is greater than or equal to 1 and less than or equal to K; and a driving unit used for according to values in a j-th sub-frame, using a driving time corresponding to the j-th sub-frame to drive thin-film transistors (TFT) in a display panel to turn on or turn off;

wherein j is sequentially assigned from 1 to K, and a first value of a bit is used for indicating to drive the TFTs to turn on and a second value of the bit is used for indicating to drive the TFTs to turn off; and wherein the image frame is equally divided into the K sub-frames, such that in one frame period of the image frame, the K sub-frames of the image frame have the same occupied time.

11. The driving display device according to claim 10, wherein the image frame includes a 3D image frame, and the 3D image frame includes a 3D left-eye image frame and a 3D right-eye image frame.

12. The driving display device according to claim 11, wherein the step of dividing the image frame into K sub-frames includes: respectively dividing the 3D left-eye image frame and the 3D right-eye image frame into K sub-frame;

wherein the step of according to values in a j-th sub-frame, using a driving time corresponding to the j-th sub-frame to drive thin-film transistors (TFT) in a display panel to turn on or turn off includes:

according to values in the j-th sub-frame of the 3D left-eye image frame, using a driving time corresponding to j-th sub-frame to drive TFTs in the display panel to turn on or turn off, wherein j is sequentially assigned from 1 to K; and after the 3D left-eye image frame finishes driving and displaying, according to values in the j-th sub-frame of 3D right-eye image frame, using a driving time corresponding to the j-th sub-frame to drive TFTs in the display panel to turn on or turn off, wherein j is sequentially assigned from 1 to K.

13. The driving display device according to claim 11, wherein the step of dividing the image frame into K sub-frames includes: respectively dividing the 3D left-eye image frame and the 3D right-eye image frame into K sub-frame;

wherein the step of according to values in a j-th sub-frame, using a driving time corresponding to the j-th sub-frame to drive thin-film transistors (TFT) in a display panel to turn on or turn off includes:

according to values in the j-th sub-frame of the 3D left-eye image frame, using a driving time corresponding to j-th sub-frame to drive TFTs in the display panel to turn on or turn off, wherein j is sequentially assigned from 1 to K; and after the j-th sub-frame of the 3D left-eye image frame drives the TFTs in the display panel to turn on or turn off, according to values in the j-th sub-frame of 3D right-eye image frame, using a driving time corresponding to the j-th sub-frame to drive TFTs in the display panel to turn on or turn off, wherein j is sequentially assigned from 1 to K.

14. The driving display device according to claim 10, wherein driving times of the K sub-frames are different.

15. The driving display device according to claim 14, wherein if a grayscale range of the display system is 0-255, K is equal to 8, the one frame period of the image frame is T, a driving time corresponding to the i-th sub-frame is $(2^{i-1}/2^7)*T/8$, wherein i is greater than or equal to 1, less than or equal to 8.

16. The driving display device according to claim 10, wherein the step of according to values in a j-th sub-frame, using a driving time corresponding to the j-th sub-frame to drive thin-film transistors (TFT) in a display panel to turn on or turn off includes:

reading values in the j-th sub-frame in a row-by-row method, the display panel controls the TFTs to turn on or turn off in the driving time corresponding to the j-th sub-frame.

17. The driving display device according to claim 10, wherein the step of according to values in a j-th sub-frame, using a driving time corresponding to the j-th sub-frame to drive thin-film transistors (TFT) in a display panel to turn on or turn off includes:

reading values in the j-th sub-frame in a row-by-row method, and in a situation that values in the j-th sub-frame are all obtained, the display panel controls the TFTs to turn on or turn off in the driving time corresponding to the j-th sub-frame.

18. The driving display device according to claim 17, wherein after values in the j-th sub-frame are all obtained, and after a preset time, the display panel controls the TFTs to turn on or turn off in the driving time corresponding to the j-th sub-frame in order to adjust a turn-on time or a turn-off time of the TFT on the display panel.

* * * * *